United States Patent [19]

Anderson

[11] Patent Number: 4,567,991

[45] Date of Patent: Feb. 4, 1986

[54] TAMPER INDICATING CHILD RESISTANT CLOSURE

[75] Inventor: Kevin V. Anderson, Spencer, Ind.

[73] Assignee: Sunbeam Plastics Corporation, Evansville, Ind.

[21] Appl. No.: 660,289

[22] Filed: Oct. 12, 1984

[51] Int. Cl.[4] ..... B65D 51/18

[52] U.S. Cl. ..... 215/216; 215/256

[58] Field of Search ..... 215/216, 253, 256, 258

[56] References Cited

U.S. PATENT DOCUMENTS

| | | | |
|---|---|---|---|
| 4,043,475 | 8/1977 | Wheeler | 215/224 |
| 4,071,156 | 1/1978 | Lowe | 215/224 |
| 4,471,878 | 9/1984 | Davis et al. | 215/216 |

*Primary Examiner*—George T. Hall

*Attorney, Agent, or Firm*—Fisher, Crampton, Groh and McGuire

[57] ABSTRACT

A tamper indicating child resistant package including a screw type closure for use with a container having a threaded neck portion. The package is comprised of a lock member on a container adjacent to the threaded neck, a closure having a top with coaxial inner and outer skirts, one or more lock elements depending from the outer skirt. The lock member is engageable with the lock elements to deflect the outer skirt to permit clearance of the lock elements and lock member upon closing of the closure relative to the container. The lock element is further deflectable radially outwardly upon radial inward squeezing of the outer skirt to clear the lock member upon removal of the closure from the container. A tamper indicating means is provided to maintain the lock element in circumferentially aligned relationship relative to the lock member, and is further provided with stop elements to cooperatively engage the stop lugs on the container. The tamper indicating means prevents removal of the closure before separating the tamper indicating means from the remainder of the closure giving evidence that the container has been tampered with.

11 Claims, 4 Drawing Figures

TAMPER INDICATING CHILD RESISTANT CLOSURE

This invention relates to screw-type closures for containers which are both child resistant and tamper indicating.

A variety of screw-type child-proof or child resistant closures and containers have been provided which require two distinct operations to achieve opening. It is also desirable to have such closures be tamper-proof or tamper indicating so that any attempt to open the container once it has been filled, is indicated by some means which can be readily observed. Also, it is desirable that the child resistant feature remains operable for repeated opening and closing procedures whereas the tamper indicating arrangement is required to operate only the first time the container is opened.

It is an object of the invention to provide a child resistant tamper indicating closure.

A child resistant tamper indicating package is provided including a closure with a frangible, removable tamper indicating means engagable with a plurality of stop members on the shoulder of the container to which the closure is threadably attached. The closure is of the type that a lock element may be deflected radially outwardly upon radial inward squeezing of the sides of the closure at some predetermined diametrically opposed points circumferentially spaced from the lock element so that the closure may clear the lock members for removal from the container. The tamper indicating means is frangible for removal from the closure and it is impossible to remove the closure without first removing the tamper indicating means.

The tamper indicating means is a removable ring or band attached along the circumference of the closure and acts to restrain the closure from being rotated by engaging a plurality of stop members or lugs along the shoulder of the container itself. When the tamper indicating means is removed, the closure may be rotated without interference from the lugs and may be removed by the operator. Since the closure may be removed only when the removable tamper indicating means has been removed, its absence gives evidence of possible prior opening.

Figure 1:
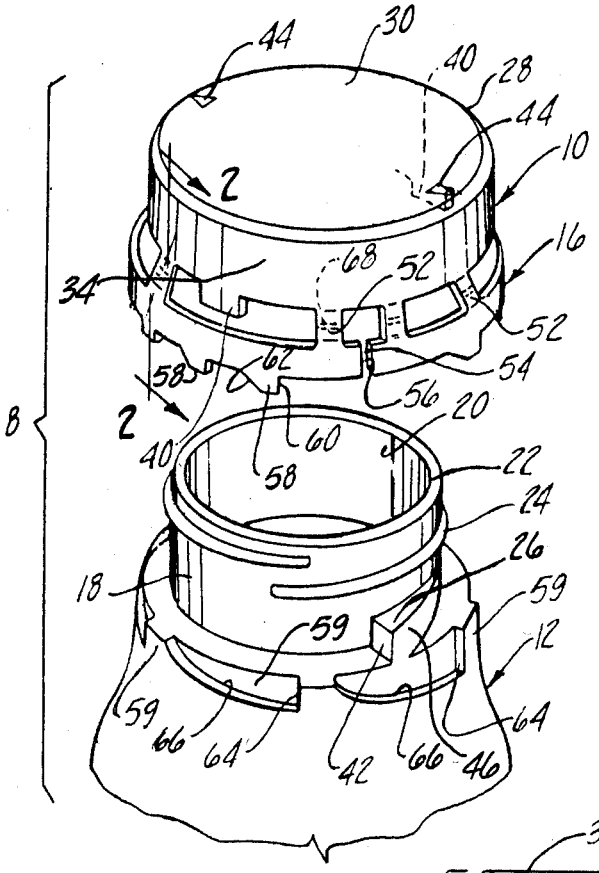
FIG. 1 is an exploded perspective view of the closure and the container embodying the present invention.

The child resistant and tamper indicating closure and container arrangement 8 of the present invention includes a closure 10 and a container 12. The basic closure arrangement is of the child resistant type in that it requires two dissimilar motions in order to bring about a removal of the closure 10 from the container 12. In the present instance, the basic closure 10 requires squeezing and simultaneous rotation of the closure in order to remove it from the container. Reapplication of the closure 10 to the container 12 is accomplished by a single form of motion, that is, by threading or rotating the cap onto the container.

In addition to the child resistant features, the closure 10 and container 12 include tamper indicating features in which a tamper indicating means indicated generally at 16 requires removal before the child resistant mechanism can be brought into operation. Absence of the tamper indicating mean gives evidence that the container has previously been opened or at least put into a condition in which it could be opened.

The closure 10 is applied to the neck 18 of the container 12. The neck 18 forms an opening 20 surrounded a sealing lip 22. Screw threads 24 are formed on the exterior of the neck 18 and a lock member 26 is molded or formed integrally with the neck at a point immediately below the threads 24.

Figure 2:
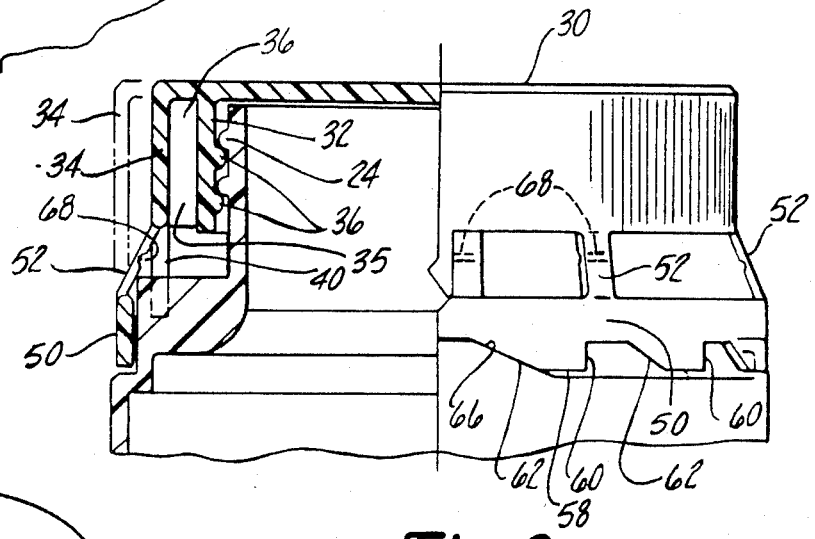
FIG. 2 is a sectional side view of the closure and adjacent portions of the container.

The basic closure portion for closing the opening 20 in the container 12 is formed by a cap portion 28. The cap portion 28 includes disc-shaped top 30 having the inner wall or skirt 32 as seen in FIG. 2 and a concentric outer wall or skirt 34. The walls 32 and 34 are spaced to form an annular groove 35. The inner wall 32 is provided with threads 36 which are complementary to the threads 24 on the closure neck 18 and are the means by which the closure 10 is maintained on the container 12.

The outer wall 34 of the cap portion 28 is provided with at least one lock element 40 which in the closed position of the cap portion 28 on the container 12 is circumferentially aligned with the lock member 26 so that unscrewing or opening rotation of the cap portion 28 is obstructed by the engagement of the lock element 40 with a lock surface 42 forming a portion of the lock member 26. If desired a second lock portion 40 can be disposed diametrically from the first lock portion as seen in FIG. 1.

Figure 3:
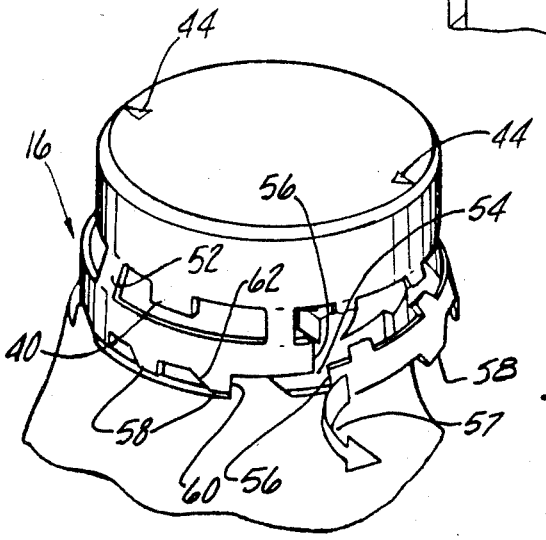
FIG. 3 is a perspective view of the closure in place on a container showing a stage in its removal from the container.

To place the cap portion 28 in condition for removal, it is necessary to deflect the outer wall 34 radially inwardly. This is accomplished by squeezing the outer wall of the cap portion 28 at diametrically spaced points indicated at 44 in FIGS. 1 and 3. This causes the lock elements 40 to flex radially outwardly an amount sufficient to clear the lock surface 42 so that the cap portion 28 can be rotated by maintaining a grip on the cap portion 28 at the squeeze points 44 and simultaneous rotating the cap portion 28 so it can be removed or unthreaded from the neck 18 of the container 12.

The cap portion 28 can be reapplied to the container 12 to close the opening 20 by simple rotation in a closing direction. During such rotation, the lock element 40 engages the cam surface 46 adjacent to the lock surface 42 on the lock member 26 to permit the lock element 40 to be deflected and to pass the lock member 26. When the cap portion 28 reaches its fully closed and sealed condition, the lock element 40 is circumferentially aligned with the lock surface 42 and opening movement will again require two dissimilar motions; namely, squeezing the cap portion 28 at diametrically spaced locations 44 and simultaneous rotation of the cap portion 28 in an opening direction.

The tamper indicating means 16 includes a band 50 which extends circumferentially around the entire cap 28 and is attached to the outer wall 34 by a plurality of spaced webs 52. The circumferential band 50 is slightly larger in diameter than the outer wall 34 so that the connecting webs 52 extend downwardly and outwardly from the outer wall 34 to the band 50. The band 50 is not continuous and a separation is formed at 54 by opposite ends 56 of the band 50 which are disposed in spaced relationship to each other. The spacing at the separation 54 facilitates grasping the band 50 when it is desired to separate it from the remainder of the closure, as seen at arrow 57 of FIG. 3.

The band 50 is provided with a plurality of depending stop elements 58 which are intended to coact with stop portions formed on the neck of the container below the level of the lock member 26. Each of the stop elements 58 has a stop surface 60 and a cam surface 62 which are complementary and coact, respectively, with a stop surface 64 and cam surface 66 associated with the stop portions 59. The complementary stop surfaces 60 and 64 prevent rotation of the circumferential band 50 and therefore movement of the cap portion 28 in an opening direction, that is, to unthread the closure 10 from the container.

To permit removal of the cap portion 28, it is necessary to separate the band 50. This is accomplished by grasping the band 50 in the area of the separation at 54 and pulling one or the other of the ends 56. Separation is facilitated by a line of weakening 68 (FIG. 2 formed in each of the webs 52. By placing the line of weakening 68 intermediate the ends of the web 52, the point at which the fracture occurs is predetermined and in this manner a portion of the web may be left attached to the cap portion 28 so that the missing tamper indicating band 50 is more noticeable to give evidence that the closure 10 has been put in condition for opening of the package.

Attachment of the closure 10 to the container 12 is facilitated by the complementary cam surfaces 62 on the stop element 58 and cam surface 66 on stop portion 59. As the cap portion 28 is threaded onto the neck of the container, the cam surfaces 62 and 66 engage each other to displace the tamper indicating band 50 axially to permit each of the stop elements 58 to pass the stop portion 59 without prematurely fracturing the connecting webs 52.

Figure 4:
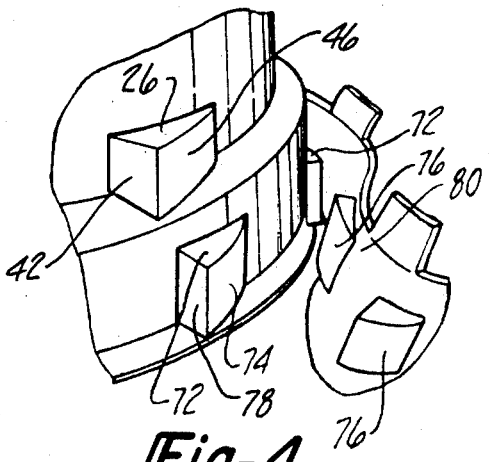
FIG. 4 is a sectional perspective view of another embodiment of the present invention showing a portion of a closure and container during removal of the tamper indicating means.

Another embodiment of the invention is disclosed in FIG. 4 in which the principal difference over the prior embodiment is that stop elements 72 corresponding to the stop elements 59 are provided with cam surfaces 74 and stop portions 78 are provided with complementary cam surfaces 76 on a tamper indicating band 80 which in all other respects can be the same as the tamper indicating band 50. Upon application of the closure with the tamper indicating band 80 to a container, the complementary cam surfaces 74 and 76 act to deflect the band 80 radially outwardly instead of axially as in the prior embodiment. Removal of the closure from the container is accomplished in the same manner as in the prior embodiment, that is, by removing the tamper indicating band 80 after which the closure can be squeezed and turned for rotation in a removal direction.

A tamper indicating and child resistant closure has been provided in which the child resistant aspects of the closure are afforded by a cap which requires squeezing at diametrically spaced points so that a lock element moves radially outwardly relative to a lock member on the container to permit rotation of the cap in an opening direction. The tamper indicating aspects of the closure are provided by a band frangibly attached to the closure and having stop elements which engage stop portions on the closure to prohibit rotation in an opening direction but do permit rotation in a closing direction. The band must be removed to permit rotation in an opening direction and the absence of the band gives evidence that the closure has been put in a condition for removal or perhaps has been removed.

The embodiments of the invention in which an exclusive property or privilege is claimed are defined as follows:

1. A tamper indicating and child resistant package including a threaded closure and a container having a threaded neck to receive said closure, said package comprising: a lock member on said container, a closure having a top with concentric inner and outer skirts depending from said top, said inner wall having threads engageable with said threaded neck on said container, a lock element on said outer wall for engaging said lock member upon opening rotation of said closure to prevent rotation beyond a predetermined point, said lock element being deflectable radially outwardly upon radial inward squeezing of said outer wall at diametrically opposed points to permit said lock element to pass said lock member and permit opening rotation of said closure, tamper indicating means detachably connected to said outer wall and including a circumferential band disposed below said outer wall, said band having a plurality of stop elements, said container having a stop member complementary to said stop elements and engageable therewith to resist rotation of said closure in an opening direction, said tamper indicating means being removable from said outer wall to permit radial movement of said lock element and rotational movement of said closure in an opening direction whereby removal of said tamper indicating means gives evidence of possible prior opening of said package.

2. The package of claim 1 wherein said lock member has a lock surface facing in one circumferential direction and wherein said lock element has a complementary lock surface facing in the other circumferential direction for engagement with each other to prevent rotation in an opening direction.

3. The package of claim 1 wherein said stop elements on said closure have a lock surface and a cam surface and wherein stop member on said container has a lock surface and a cam surface, said lock surfaces being complementary to each other to prevent rotation of said closure in an opening direction and said cam surfaces being complementary to each other to provide deflection of said band upon application of said closure to said container.

4. The package of claim 3 wherein said cam surfaces provide for deflection of said band axially of said container.

5. The package of claim 3 wherein said cam surfaces provide for radial deflection of said band relative to said container.

6. The package of claim 1 wherein said band is interrupted circumferentially to provide abutting ends to facilitate removal of said band from said closure.

7. The package of claim 1 wherein said band is disposed substantially circumferentially and concentric with said outer wall and wherein said band is disposed radially outwardly of said outer wall.

8. The package of claim 3 wherein a plurality of stop members are disposed on said container.

9. The package of claim 1 wherein said band is connected to said outer wall by a plurality of circumferentially spaced frangible webs.

10. The package of claim 9 wherein said webs are frangible at a point intermediate the ends of said webs to leave a portion of said webs attached to said closure after removal of said band.

11. The package of claim 10 wherein said lock element is disposed between an adjacent pair of said webs.

* * * * *